United States Patent [19]

Hara et al.

[11] 4,120,723

[45] Oct. 17, 1978

[54] COLOR PHOTOGRAPHIC LIGHT-SENSITIVE ELEMENT

[75] Inventors: Hiroshi Hara; Kotaro Nakamura, both of Kanagawa, Japan

[73] Assignee: Fuji Photo Film Co., Ltd., Minami Ashigara, Japan

[21] Appl. No.: 805,959

[22] Filed: Jun. 13, 1977

[30] Foreign Application Priority Data

Jun. 11, 1976 [JP] Japan ..... 51-69147

[51] Int. Cl.[2] ..... G03C 1/40; G03C 1/76

[52] U.S. Cl. ..... 96/74; 96/56; 96/100 R

[58] Field of Search ..... 96/56, 56.5, 74, 100

[56] References Cited

U.S. PATENT DOCUMENTS

| | | | |
|---|---|---|---|
| 3,519,429 | 7/1970 | Lestina | 96/56 |
| 3,698,909 | 10/1972 | Lestina et al. | 96/100 |
| 3,907,571 | 9/1975 | Arai et al. | 96/56 |
| 3,930,866 | 1/1976 | Oishi et al. | 96/56.5 |

*Primary Examiner*—J. Travis Brown
*Attorney, Agent, or Firm*—Sughrue, Rothwell, Mion, Zinn and Macpeak

[57] ABSTRACT

A color photographic light-sensitive element comprising a support having thereon a photographic layer containing (a) at least one magenta coupler represented by the general formula (II):

(II)

wherein $Y_1$ represents a halogen atom, an alkyl group having 1 to 5 carbon atoms or an alkoxy group having 1 to 5 carbon atoms; $Y_2$ and $Y_3$, which may be the same or different, each represents a hydrogen atom, a halogen atom, an alkyl group having 1 to 5 carbon atoms or an alkoxy group having 1 to 5 carbon atoms; $R_1$ represents $R_2CONH$—, $R_2OOC$—, $R_2NHSO_2$— or wherein $R_2$ represents a hydrogen atom, a straight chain or branched chain alkyl group having 1 to 35 carbon atoms, preferably 1 to 22 carbon atoms, an alkenyl group having 2 to 22 carbon atoms, a cycloalkyl group having 5 to 22 carbon atoms, an aralkyl group having 7 to 22 carbon atoms or a cycloalkenyl group having 5 to 22 carbon atoms; which groups can be substituted with one or more of a substituent selected from a halogen atom, a nitro group, a cyano group, an aryl group, an alkoxy group, a carboxy group, an alkylcarbonyl group, an arylcarbonyl group, an alkoxycarbonyl group, an aryloxycarbonyl group, a formyl group, a sulfo group, an acyloxy group, a sulfamoyl group, a carbamoyl group, an acylamino group, a diacylamino group, a ureido group, a thioureido group, a urethane group, a thiourethane group, a sulfonamido group, a heterocyclic group, an arylsulfonyloxy group, an alkylsulfonyloxy group, an arylsulfonyl group, an alkylsulfonyl group, an arylthio group, an alkylthio group, an alkylsulfinyl group, an arylsulfinyl group, an alkylamino group, a dialkylamino group, an anilino group, an N-arylanilino group, an N-alkylanilino group, an N-acylanilino group, a hydroxy group or a mercapto group; and (b) at least one color image stabilizer represented by the general formula (III):

(III)

wherein $R_3$ represents a hydrogen atom, an alkyl group having 1 to 35 carbon atoms, an alkenyl group, a cycloalkyl group, an aralkyl group, a cycloalkenyl group and an aryl group having 6 to 35 carbon atoms; $n$ is an integer of 1 to 4 and when $n$ is 2 to 4, the $R_3$ groups may be the same or different; the group represented by is substituted at a position unsubstituted with $R_3$ and wherein $R_4$ and $R_5$, which may be the same or different, each represents a hydrogen atom, an alkyl group having 1 to 35 carbon atoms, an alkenyl group, a cycloalkyl group, an aralkyl group or a cycloalkenyl group; and Y represents a hydrogen atom, an alkyl group having 1 to 35 carbon atoms, an alkenyl group, an aralkyl group, a cycloalkyl group, a cycloalkenyl group, an aryl group having 6 to 35 carbon atoms, an alkoxy group, an aryloxy group, an alkylthio group, an arylthio group, an amino group, an arylamino group, an alkylamino group, a cyclic amino group, a heterocyclic amino group or a hydroxy group.

22 Claims, No Drawings

COLOR PHOTOGRAPHIC LIGHT-SENSITIVE ELEMENT

BACKGROUND OF THE INVENTION

1. FIELD OF THE INVENTION

The present invention relates to a color photographic light-sensitive element, more particularly, it relates to a method for preventing the fading of a magenta dye image which is formed upon coupling of an anilino type coupler with an oxidation product of a paraphenylenediamine or a derivative thereof due to light and/or heat and preventing the discoloration in non-color image areas.

2. DESCRIPTION OF THE PRIOR ART

Color photographic light-sensitive elements are, in general, prepared by coating on an appropriate support a silver halide emulsion containing couplers dispersed therein. Conventional color photographic light-sensitive elements are produced by dispersing couplers capable of forming cyan, magenta and yellow dyes upon coupling with the oxidation products of color developing agents into a red-sensitive, green-sensitive and blue-sensitive silver halide emulsions, respectively, and coating these emulsions in an appropriate order on a support.

Color photographic light-sensitive elements thus produced are subjected, after exposure, to a series of processing steps such as color development, bleaching, fixing, stabilizing, etc., to form final color images. In such a processing, color dye images are formed together with silver images in a color developer solution containing a color developing agent and then the silver images are oxidized in a bleaching solution and subsequently removed with a fixing solution. The bleaching step and the fixing step can also be carried out in a mono bath of bleach-fixing solution. It is also known to add a subsequent step with a bath for stabilizing the dye images thus formed.

Recently, an intensification process in which similar color dye images are formed, but using several tenths of the amount of silver halide present in an ordinary light-sensitive element, has been developed. A cobalt (III) complex salt as described in Japanese patent application (OPI) No. 9728/1973 (corresponding to U.S. Pat. No. 3,834,907) and a peroxide as described in German patent application (OLS) No. 1,813,920 are known as intensifying agents. In such a processing, silver images and color dye images are formed in a color developer solution just as in a conventional process and dyes are further formed by the reaction of a coupler with a color developing agent oxidized with an intensifying agent in the presence of silver as a catalyst. Thus, a reduced amount of silver such as only several tenths of the amount present in an ordinary color photographic element is employed and such a process is suitable for conservation of natural resources. After the intensification step the silver is removed with bleaching and fixing steps and the dye images remain in the photographic element. The dyes formed in both processes are the same azomethine dyes or indoaniline dyes.

The photographic images thus obtained are often stored as record for a long period of time or are exhibited. However, the photographic images are not sufficiently stable to light, heat and/or humidity and when the photographic images are exposed to light for a long period of time or stored under conditions of high temperature and high humidity, a fading or discoloration of the dye images and a discoloration of non-image areas usually occur resulting in a deterioration of the image qualities.

5-Pyrazolone type compounds are widely used as a photographic magenta coupler. When a light-sensitive element having a photographic layer containing a silver halide emulsion and a coupler are exposed through an optical wedge and developed in a developer solution containing a developing agent such as paraphenylenediamine, a large amount of dye is formed upon coupling of the coupler with the developing agent and a small amount of coupler which does not form a dye remains in areas subjected to a large amount of exposure. On the other hand, in areas subjected to a small amount of exposure the coupler which does not form a dye remains in a large extent and in areas which were not exposed none of the coupler forms a dye and all of the coupler remains. The unexposed areas are non-image areas.

It is known that dyes formed from 3-acylamino-5-pyrazolone couplers of the class of 5-pyrazolone couplers are converted by means of heat into their leuco forms and thus fading occurs where residual coupler is present.

Accordingly, a subsequent development bath treatment with a solution containing formaldehyde is conventionally employed in order to deactivate remaining couplers. However, it is desirable to omit this treatment since formaldehyde is poisonous to the human body. On the contrary, fading of the image formed from 3-anilino-5-pyrazolone couplers does not occur due to heat even in the absence of treatment with a bath containing formaldehyde in processing steps and also these couplers have many superior properties such as color hue of the dyes formed therefrom.

Therefore, many investigations have been made on 3-anilino-5-pyrazolone couplers and examples of 3-anilino-5-pyrazolone couplers are described in U.S. Pat. Nos. 3,127,269, 3,615,506, 3,684,514 and 3,935,015.

However, 3-anilino-5-pyrazolone couplers are unstable to light in comparison with 3-acylamino-5-pyrazolone couplers and the particular disadvantage in that when unexposed areas in which a large amount of coupler remains are exposed to light for a long period of time a yellow stain occurs is encountered. It is known, however, that in order to prevent the formation of such a yellow stain due to light, a hydroquinone derivative such as di-tert-octylhydroquinone or a phenol derivative can be used in combination therewith. Examples are described, for example, in British Pat. No. 1,347,556 and Japanese patent application (OPI) No. 134,327/1974 (corresponding to U.S. Pat. No. 3,930,866).

Further, it is also known that 3-anilino-5-pyrazolone couplers having a group which prevents fading incorporated in the molecule thereof show reduced formation of yellow stain due to light as a result of the fading preventing group such as a phenoxy group in the molecule thereof as described, for example, in U.S. Pat. No. 3,519,429 and Japanese Patent Application (OPI) No. 110,344/1974.

The extent of yellow stain preventing effects by such a hydroquinone derivative or a phenol derivative depends largely on the structure of the oil solubilizing group of the 3-anilino-5-pyrazolone coupler. For example, a 3-anilino-5-pyrazolone coupler characterized by its oil solubilizing group and represented by the general formula (I) shown below:

(I)

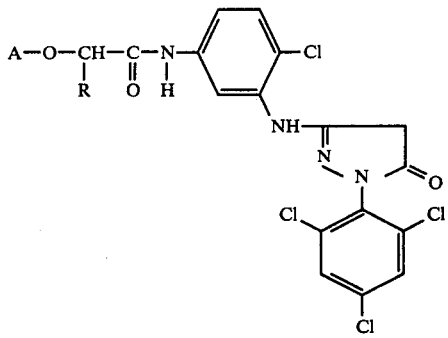

wherein R represents an alkyl group having 2 to 22 carbon atoms; and A represents a phenyl or naphthyl group substituted with one or two lower alkyl groups is advantageous because yellow stain formation is small and such is further reduced by the presence of an alkylhydroquinone compound therewith but this coupler type has the disadvantages that the solubility in a high boiling organic solvent such as dioctyl butyl phosphate is low, the coupling reactivity is low and the preparation thereof is difficult.

It is desired to develop a method for improving these characteristics and yet retain the small amount of yellow stain due to residual coupler remaining when using an alkylhydroquinone compound in combination therewith.

On the other hand, a 3-anilino-5-pyrazolone coupler characterized by the oil solubilizing group thereof and represented by the general formula (II) shown below has the advantages of good solubility, a high coupling reactivity and ease of preparation. However, the coupler is disadvantageous in that the stability of the color image formed is inferior and a large amount of yellow stain due to residual coupler occurs when it is exposed to light for a long period of time and in that this yellow stain due to light is prevented to a lesser extent by use of an alkylhydroquinone compound in combination therewith.

SUMMARY OF THE INVENTION

An object of the present invention is to provide a color photographic light-sensitive element in which a 3-anilino-5-pyrazolone coupler which has good solubility in a high boiling organic solvent and a high coupling reactivity and represented by the general formula (II) shown below is used and which element provides magenta color images having a superior light-fastness and in which yellow stain due to the residual magenta couplers is not formed.

Various investigations have been made and it has now been found that the above-described object is accomplished with a color photographic light-sensitive element comprising a support having thereon a photographic layer containing at least one magenta coupler represented by the general formula (II):

(II)

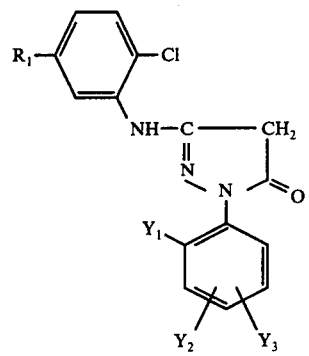

wherein $Y_1$ represents a halogen atom, an alkyl group having 1 to 5 carbon atoms or an alkoxy group having 1 to 5 carbon atoms; $Y_2$ and $Y_3$, which may be the same or different, each represents a hydrogen atom, a halogen atom, an alkyl group having 1 to 5 carbon atoms or an alkoxy group having 1 to 5 carbon atoms; $R_1$ represents $R_2CONH$—, $R_2OOC$—, $R_2NHSO_2$— or

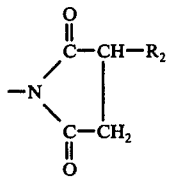

wherein $R_2$ represents a hydrogen atom, a straight chain or branched chain alkyl group having 1 to 35 carbon atoms, an alkenyl group having 2 to 22 carbon atoms, a cycloalkyl group having 5 to 22 carbon atoms, an aralkyl group having 7 to 22 carbon atoms or a cycloalkenyl group having 5 to 22 carbon atoms and at least one color image stabilizer represented by the general formula (III):

(III)

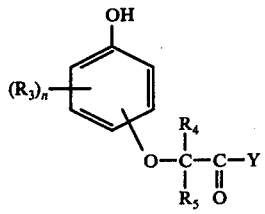

wherein $R_3$ represents a hydrogen atom, an alkyl group having 1 to 35 carbon atoms, an alkenyl group having 2 to 22 carbon atoms, a cycloalkyl group having 5 to 22 carbon atoms, an aralkyl group having 7 to 22 carbon atoms, a cycloalkenyl group having 5 to 22 carbon atoms and an aryl group having 6 to 35 carbon atoms; $n$ represents an integer of 1 to 4 and where $n$ is 2 to 4, the $R_3$ groups may be the same or different; the

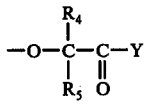

group is substituted at a position unsubstituted with $R_3$ and wherein $R_4$ and $R_5$, which may be the same or different, each represents a hydrogen atom, an alkyl group having 1 to 35 carbon atoms, an alkenyl group having 2 to 22 carbon atoms, a cycloalkyl group having 5 to 22 carbon atoms, an aralkyl group having 7 to 22 carbon atoms or a cycloalkenyl group having 5 to 22 carbon atoms; and Y represents a hydrogen atom, an alkyl group having 1 to 35 carbon atoms, an alkenyl group having 2 to 22 carbon atoms, an aralkyl group having 7 to 22 carbon atoms, a cycloalkyl group having 5 to 22 carbon atoms, a cycloalkenyl group having 5 to 22 carbon atoms, an aryl group having 6 to 35 carbon atoms, an alkoxy group having 1 to 22 carbon atoms, an aryloxy group having 6 to 22 carbon atoms, an alkylthio group having 1 to 22 carbon atoms, an arylthio group having 6 to 22 carbon atoms, an amino group, an arylamino group having 6 to 22 carbon atoms, an alkylamino group having 1 to 22 carbon atoms, a cyclic amino group having 4 to 22 carbon atoms, a heterocyclic amino group having 2 to 22 carbon atoms or a hydroxy group.

DETAILED DESCRIPTION OF THE INVENTION

As described above, the 3-anilino-5-pyrazolone magenta coupler according to the present invention is represented by the following general formula (II):

(II)

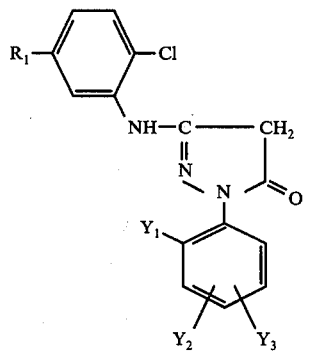

wherein $Y_1$ represents a halogen atom, an alkyl group having 1 to 5 carbon atoms (for example, a methyl group, etc.), or an alkoxy group having 1 to 5 carbon atoms (for example, a methoxy group, an ethoxy group, etc.); $Y_2$, $Y_3$, which may be the same or different, each represents a hydrogen atom, a halogen atom (for example, a chlorine atom, a bromine atom, etc.), an alkyl group having 1 to 5 carbon atoms (for example, a methyl group, an ethyl group, etc.), or an alkoxy group having 1 to 5 carbon atoms (for example, a methoxy group, an ethoxy group, etc.); $R_1$ represents $R_2CONH$—, $R_2OOC$—, $R_2NHSO_2$— or

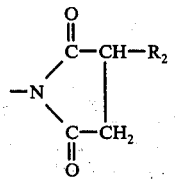

wherein $R_2$ represents a hydrogen atom, a straight chain or branched chain alkyl group having 1 to 35 carbon atoms, preferably 1 to 22 carbon atoms (for example, a methyl group, an isopropyl group, a tert-butyl group, a hexyl group, a dodecyl group, etc.), an alkenyl group having 2 to 22 carbon atoms (for example, an allyl group, etc.), a cycloalkyl group having 5 to 22 carbon atoms (for example, a cyclopentyl group, a cyclohexyl group, a norbornyl group, etc.), an aralkyl group having 7 to 22 carbon atoms (for example, a benzyl group, a β-phenylethyl group, etc.), or a cycloalkenyl group having 5 to 22 carbon atoms (for example, a cyclopentenyl group, a cyclohexenyl group, etc.); which $R_2$ groups can be substituted with one or more of a substituent selected from a halogen atom (e.g., a chlorine, bromine, fluorine, etc., atom), a nitro group, a cyano group, an aryl group having 6 to 22 carbon atoms (e.g., a phenyl, tolyl, methoxyphenyl, naphthyl, etc., group), an alkoxy group having 1 to 22 carbon atoms (e.g., a methoxy, butoxy, octyloxy, etc., group), a carboxyl group, an alkylcarbonyl group having 2 to 22 carbon atoms (e.g., a methylcarbonyl, octylcarbonyl, etc., group), an arylcarbonyl group having 7 to 22 carbon atoms (e.g., a phenylcarbonyl, tolylcarbonyl, etc., group), an alkoxycarbonyl group having 2 to 22 carbon atoms (e.g., a methoxycarbonyl, butoxycarbonyl, etc., group), an aryloxycarbonyl group having 7 to 22 carbon atoms (e.g., a phenoxycarbonyl, tolyloxycarbonyl, etc., group), a formyl group, a sulfo group, an acyloxy group (e.g., an acetoxy group, etc.), a sulfamoyl group (e.g., an N-methylsulfamoyl, N,N-diethylsulfamoyl, N-methyl-N-phenylsulfamoyl, etc., group), a carbamoyl group having 2 to 22 carbon atoms (e.g., an N-ethylcarbamoyl, N-methyl-N-decylcarbamoyl, N-phenylcarbamoyl, etc., group), an acylamino group having 2 to 22 carbon atoms (e.g., an acetamido, butyramido, benzamido, etc., group), a diacylamino group having 4 to 22 carbon atoms in total (e.g., a phthalimido, 3-heptadecylsuccinimido, etc., group), a ureido group having 2 to 22 carbon atoms (e.g., an ethylureido, phenylureido, chlorophenylureido, etc., group), a thioureido group having 1 to 22 carbon atoms (e.g., an ethylthioureido, phenylthioureido, chlorophenylthioureido, etc., group), a urethane group (such as an alkoxycarbamido group having 2 to 22 carbon atoms (e.g., a methyloxycarbamido, octoxycarbamido, etc., group), an aryloxycarbamido group having 6 to 22 carbon atoms (e.g., a phenoxycarbamido group, etc.), etc., group), a thiourethane group (such as an alkylthiocarbamido group having 2 to 22 carbon atoms (e.g., a methylthiocarbamido, octylthiocarbamido, etc., group) an arylthiocarbamido group having 6 to 22 carbon atoms (e.g., a phenylthiocarbamido group, etc.), etc., group), a sulfonamido group (such as an alkylsulfonamido having 1 to 22 carbon atoms (e.g., methylsulfonamido, ethylsulfonamido, etc.), arylsulfonamido having 6 to 22 carbon atoms (e.g., phenylsulfonamido, etc.), etc., group), a heterocyclic group (e.g., a 5-or 6-membered heterocyclic group or condensed heterocyclic group containing at least one hetero atom selected from nitrogen, oxygen and sulfur atoms, such as a furyl, oxazolyl, benzothiazolyl, imidazolyl, etc., group), an arylsulfonyloxy group having 6 to 22 carbon atoms (e.g., a phenylsulfonyloxy, tolylsulfonyloxy, etc., group), an alkylsulfonyloxy group having 1 to 22 carbon atoms (e.g., an ethylsulfonyloxy, dodecylsulfonyloxy, etc., group), an arylsulfonyl group having 6 to 22 carbon atoms (e.g., a phenylsulfonyl, tolylsulfonyl, etc., group), an alkylsulfonyl group having 1 to 22 carbon atoms (e.g., a methylsulfonyl, octylsulfonyl, etc., group), an arylthio group having 6 to 22 carbon atoms (e.g., a phenylthio, tolylthio, etc., group), an alkylthio group having 1 to 22 carbon atoms (e.g., a methylthio, octylthio, dodecylthio, etc., group), an alkylsulfinyl group having 1 to 22 carbon atoms (e.g., a methylsulfinyl, hexylsulfinyl, etc., group), an arylsulfinyl group having 6 to 22 carbon atoms (e.g., a phenylsulfinyl, tolylsulfinyl, etc., group), an alkylamino group having 1 to 22 carbon atoms (e.g., a methylamino, butylamino, etc., group), a dialkylamino group having 2 to 22 carbon atoms in total (e.g., an N,N-diethylamino, N-methyl-N-decylamino, etc., group), an anilino group, an N-alkylanilino having 7 to 22 carbon atoms in total (e.g., N-methylanilino, etc.), N-arylanilino having 12 to 22 carbon atoms in total (e.g., N-phenylanilino, etc.), N-acylanilino having 8 to 22 carbon atoms in total (e.g., 2-chloro-5-tetradecanamidoanilino, etc.), etc., group), a hydroxyl group, or a mercapto group.

Specific examples of the compounds included in the general formula (II) are illustrated below but the magenta couplers which can be used in the present invention are not to be construed as being limited to these examples.

(A)

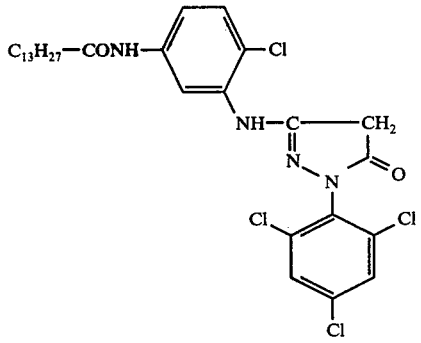

(B)

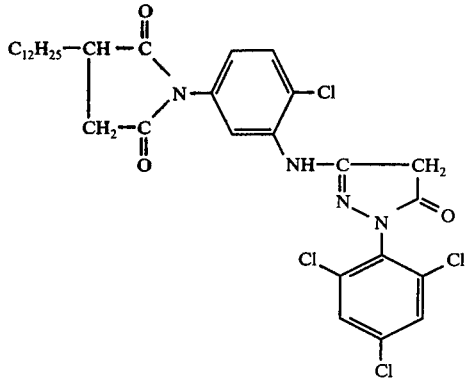

(C)

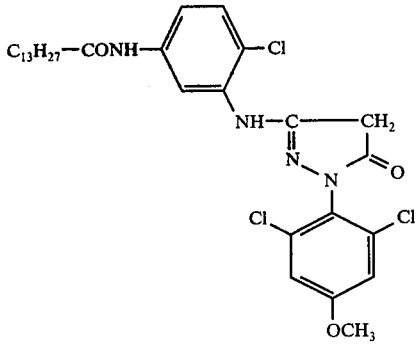

-continued (D)

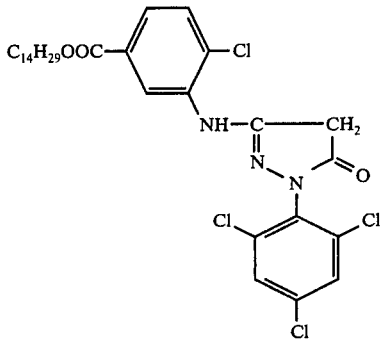

(E)

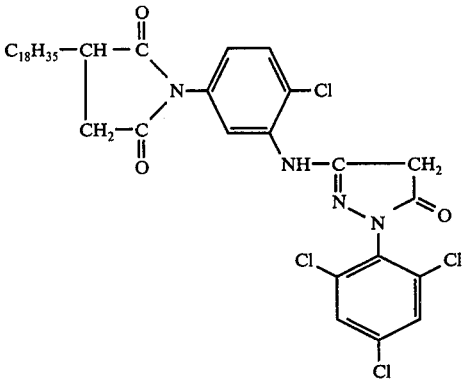

(F)

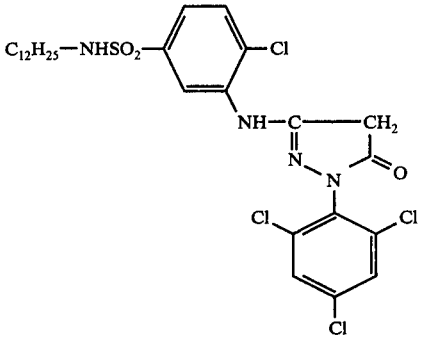

(G)

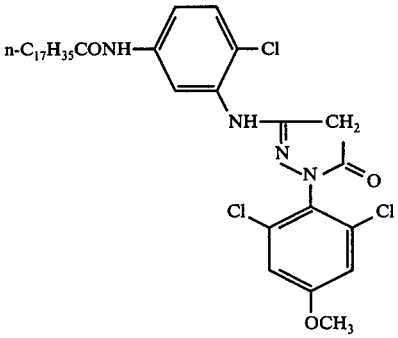

The 3-anilino-5-pyrazolone magenta couplers represented by the general formula (II) are described in U.S. Patents 3,928,044 and 3,935,015, Japanese patent application No. 10,540/1976, Japanese patent application (OPI) No. 27,930/1973, corresponding to U.S. Pat. No. 3,684,514, etc.

As set forth above, the color image stabilizer used in this invention is represented by the general formula (III):

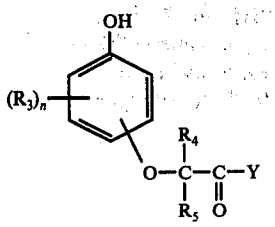

(III)

wherein $R_3$ represents a hydrogen atom, an alkyl group having 1 to 35 carbon atoms, an alkenyl group having 2 to 22 carbon atoms, a cycloalkyl group having 5 to 22 carbon atoms, an aralkyl group having 7 to 22 carbon atoms, a cycloalkenyl group having 5 to 22 carbon atoms and an aryl group having 6 to 35 carbon atoms; wherein the group represented by

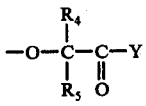

is substituted at a position unsubstituted with $R_3$ and wherein $R_4$ and $R_5$, which may be the same or different, each represents a hydrogen atom, an alkyl group having 1 to 35 carbon atoms, an alkenyl group having 2 to 22 carbon atoms, a cycloalkyl group having 5 to 22 carbon atoms, an aralkyl group having 7 to 22 carbon atoms or a cycloalkenyl group having 5 to 22 carbon atoms; and Y represents a hydrogen atom, an alkyl group having 1 to 35 carbon atoms, an alkenyl group having 2 to 22 carbon atoms, an aralkyl group having 7 to 22 carbon atoms, a cycloalkyl group having 5 to 22 carbon atoms, a cycloalkenyl group having 5 to 22 carbon atoms, an aryl group having 6 to 35 carbon atoms, an alkoxy group having 1 to 22 carbon atoms, an aryloxy group having 6 to 22 carbon atoms, an alkylthio group having 1 to 22 carbon atoms, an arylthio group having 6 to 22 carbon atoms, an amino group, an arylamino group having 6 to 22 carbon atoms, an alkylamino group having 1 to 22 carbon atoms, a cyclic amino group having 4 to 22 carbon atoms, a heterocyclic amino group having 2 to 22 carbon atoms or a hydroxy group. $n$ represents an integer of 1 to 4 and where $n$ is 2 to 4 the $R_3$ groups may be the same or different.

The substituents $R_3$ and

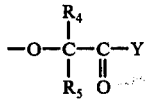

of the phenol derivative represented by the general formula (III) are described below in greater detail.

That is, $R_3$ represents a hydrogen atom, a straight chain or branched chain alkyl group having 1 to 35 carbon atoms, preferably 1 to 22 carbon atoms (for example, a methyl group, an isopropyl group, a tert-butyl group, a hexyl group, a dodecyl group, etc.), an alkenyl group (for example, an allyl group, etc.), a cycloalkyl group (for example, a cyclopentyl group, a cyclohexyl group, a norbornyl group, etc.), an aralkyl group (for example, a benzyl group, a $\beta$-phenylethyl group, etc.), or a cycloalkylenyl group (for example, a cyclopentenyl group, a cyclohexenyl group, etc.); which groups can be substituted with one or more of a substituent as defined for the substituent group for $R_2$. Further, the above groups for $R_3$ can be substituted with an aryloxy group having 6 to 22 carbon atoms (e.g., a phenoxy, tolyloxy, naphthoxy, etc., group). Further, $R_3$ represents an aryl group having 6 to 35 carbon atoms (for example, a phenyl group, an $\alpha$- or $\beta$-naphthyl group, etc.) or an aryl group which may be substituted with one or more of a substituent selected from an alkyl group, an alkenyl group, a cycloalkyl group, an aralkyl group, a cycloalkenyl group, a halogen atom, a nitro group, a cyano group, an aryl group, an alkoxy group, an aryloxy group, a carboxy group, an alkylcarbonyl group, an arylcarbonyl group, an alkoxycarbonyl group, an aryloxycarbonyl group, a formyl group, a sulfo group, an acyloxy group, a sulfamoyl group, a carbamoyl group, an acylamino group, a diacylamino group, a ureido group, a thioureido group, a urethane group, a thiourethane group, a sulfonamido group, a heterocyclic group, an arylsulfonyloxy group, an alkylsulfonyloxy group, an arylsulfonyl group, an alkylsulfonyl group, an arylthio group, an alkylthio group, an alkylsulfinyl group, an arylsulfinyl group, an alkylamino group, a dialkylamino group, an anilino group, an N-alkylanilino group, an N-arylanilino group, an N-acylanilino group, a hydroxy group and a mercapto group.

One to four $R_3$ groups which may be the same or different, and selected from the above-described groups may be present.

On the other hand, the

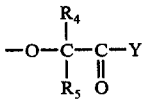

group is substituted at a position unsubstituted with an $R_3$ group and wherein $R_4$ and $R_5$, which may be the same or different, each represents a hydrogen atom, a straight chain or branched chain alkyl group having 1 to 35 carbon atoms, preferably 1 to 22 carbon atoms, an alkenyl group, a cycloalkyl group, an aralkyl group or a cycloalkenyl group and which groups can be substituted with one or more of a substituent as described above in regard to $R_3$.

Y represents a hydrogen atom, a straight chain or branched chain alkyl group having 1 to 35 carbon atoms, preferably 1 to 22 carbon atoms, an alkenyl group, an aralkyl group, a cycloalkyl group or a cycloalkenyl group and which groups can be substituted with one or more of a substituent as described above in regard to these groups for $R_3$. Further, Y represents an aryl group having 6 to 35 carbon atoms or an aryl group which may be substituted with one or more of a substituent selected from the substituents as described above in regard to the aryl group for $R_3$. Furthermore, Y represents an alkoxy group (for example, a methoxy group, an ethoxy group, a decyloxy group, etc.), an aryloxy group (for example, a phenoxy group, a tolyloxy group, etc.), an alkylthio group (for example, an ethylthio group, a dodecylthio group, etc.), an arylthio group (for example, a phenylthio group, an $\alpha$-naphthylthio group, etc.), an amino group, an arylamino group (for example, a phenylamino group, an N-alkylanilino group, an N-acylanilino group, etc.), an alkylamino group (for example, an n-butylamino group, an N,N-dialkylamino group, a cycloalkylamino group, etc.), a cyclic amino group (for example, a piperidino group, a pyrrolidino group, etc.), a heterocyclic amino group (for example, a 4-pyridylamino group, a 2-oxazolylamino group, etc.), or a hydroxy group.

Specific examples of the compounds included in the general formula (III) are illustrated below but the phenol derivatives of the general formula (III) which can be used in the present invention are not to be construed as being limited to these examples.

(1)

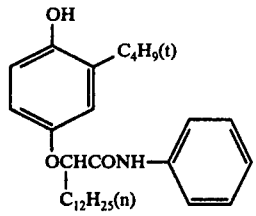

(2)

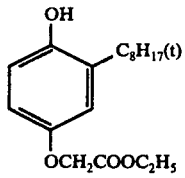

(3)

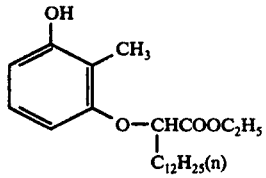

(4)

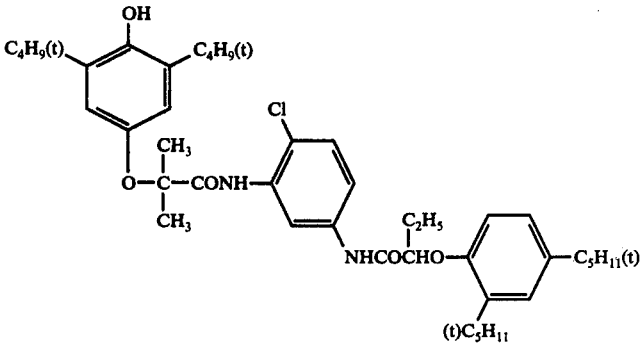

(5)

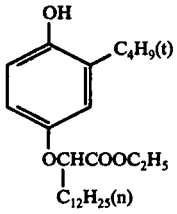

(6)

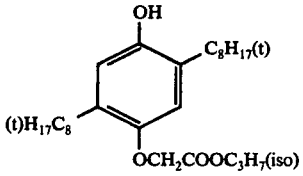

(7)

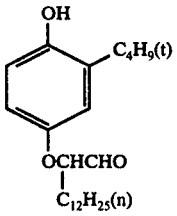

-continued
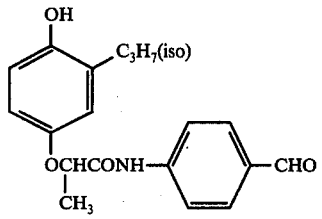
(8)
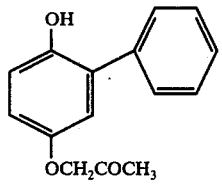
(9)
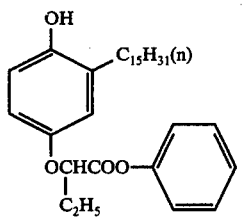
(10)
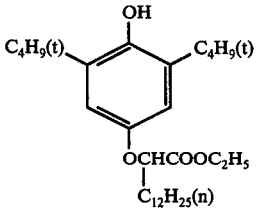
(11)
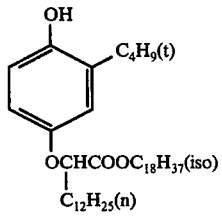
(12)
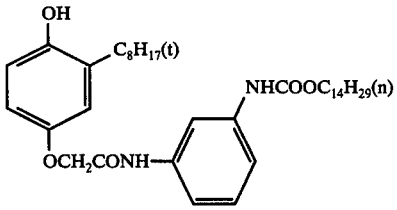
(13)
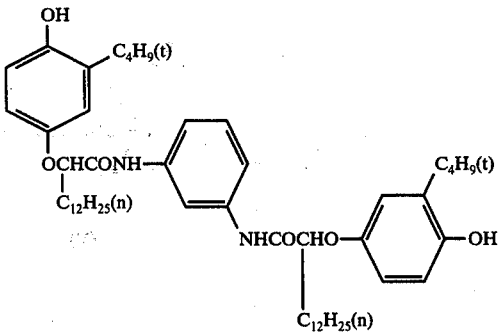
(14)

-continued (15)

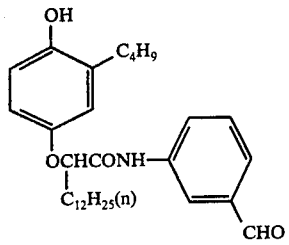

(16)

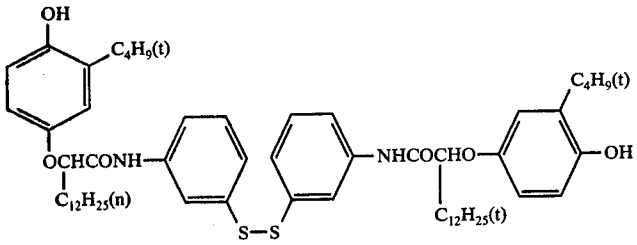

(17)

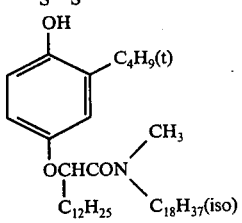

(18)

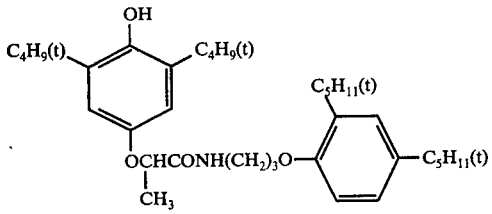

(19)

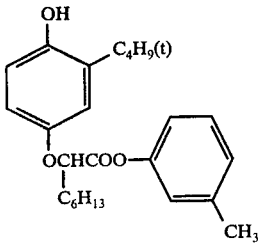

(20)

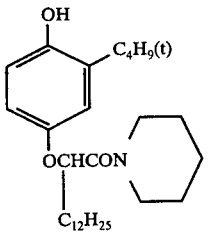

The compounds represented by the general formula (III) according to the present invention and the starting materials of the general formulae (IV), (V), (VI) and (VII) used in the synthesis thereof can be prepared using the method of preparation described in U.S. Pat. No. 3,519,429. That is, a compound of the general formula (VI) is prepared easily and in a high yield from a hydroxyphenol of the general formula (IV) and an α-halocarboxylic acid ester of the general formula (V) according to the following schematic.

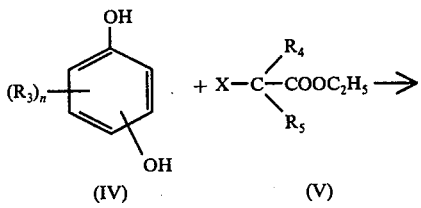

(IV) (V)

-continued

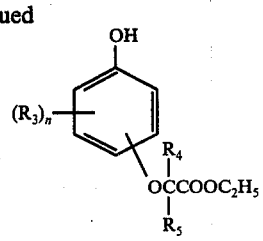

(VI)

wherein $R_3$, $R_4$ and $R_5$ each has the same meaning as defined in the general formula (III) and X represents a chlorine atom or a bromine atom. Then a compound of the general formula (VII) is easily prepared from a compound of the general formula (VI) according to the method described in U.S. Pat. No. 3,519,429.

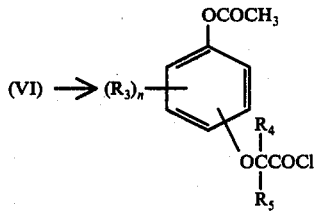

(VII)

wherein $R_3$, $R_4$ and $R_5$ are as described above.

The compound included in the present invention is easily prepared using the above-described compound (VII) as a starting material using known methods of preparation as described in the literature. For example, the so-called Rosenmund Reduction in which an acid chloride is catalytically reduced in a hydrogen atmosphere using a catalyst such as palladium, etc., to form an aldehyde as described in E. Mosettig, *Organic Reactions*, Vol. IV, page 362 (1948) can be employed in producing the compound of the general formula (III) used in the present invention. Also, the method of preparing an ester by reacting an acid chloride with an alcohol as described in C. Raha, *Organic Synthesis*, Vol. 33, page 20 (1953) and the reaction of an acid chloride with various amines to form an acid amide as described in *Chem. Rev.*, Vol. 52, page 237 (1953) can both be employed in producing the compound of the general formula (III) used in the present invention. The compounds of the general formula (III) used in the present invention can also be prepared using the methods as described above and are described in U.S. Pat. No. 3,519,429.

Typical synthesis examples of the compounds of the general formula (III) are illustrated below. Unless otherwise indicated herein, all parts, percents, ratios and the like are by weight.

SYNTHESIS EXAMPLE 1

Preparation of Ethyl α-(4-Hydroxy-3-tert-butylphenoxy)-tetradecanoate [Compound (5)]

116 g of tert-butylhydroquinone, 234 g of ethyl α-bromotetradecanoate and 170 g of potassium carbonate were mixed in 1.6 liters of acetone and reacted for 48 hours under refluxing and stirring. After the reaction, the acetone was distilled off and the residue was dissolved in one liter of ethyl acetate. The organic solvent layer was washed with water, dried with sodium sulfate and concentrated. The residue was recrystallized from 250 ml of n-hexane to obtain 110 g of a white solid. The melting point was 45° to 48° C.

SYNTHESIS EXAMPLE 2

Preparation of α-(4-Hydroxy-3-tert-butylphenoxy)tetradecanoylanilide [Compound (1)]

45.2 g of α-(4-acetoxy-3-tert-butylphenoxy)tetradecanoyl chloride prepared by a method described in U.S. Pat. No. 3,519,429 and 9.3 g of aniline were dissolved into 500 ml of acetonitrile and the solution was refluxed for 6 hours with stirring. After the reaction, the acetonitrile was distilled off and to the residue was added 300 ml of a 2.5% methanolic solution of potassium hydroxide. After stirring at room temperature (about 20°–30° C.) for 10 minutes, the solution was poured into one liter of ice water and the pH of which was adjusted to 6 with concentrated hydrochloric acid. The precipitate deposited was collected by filtration and recrystallized from n-hexane to obtain 18 g of a white solid. The melting point was 47° to 49° C.

In order to incorporate the compound of the formula (III) used in the present invention into a photographic layer containing the coupler represented by the general formula (II) of a color light-sensitive element, it is desirable to use a dispersion which is prepared by dissolving the compound of the formula (III) together with the coupler of the formula (II) in a high boiling solvent such as dibutyl phthalate, tricresyl phosphate, etc., and dispersing the solution in a hydrophilic protective colloid such as gelatin, etc., as oil droplets or a dispersion of the color image stabilizer of the present invention of the formula (III) alone or together with a dispersion of the coupler of the formula (II) into a silver halide emulsion, although a method in which the compound of the formula (III) is dissolved in a low boiling organic solvent such as ethyl acetate, ethanol, etc., and the solution is directly added to a mixture of a silver halide emulsion and a dispersion of the coupler of the formula (II) can also be used.

The photographic layer to which the magenta coupler represented by the general formula (II) and the color image stabilizer represented by the general formula (III) both are added according to the present invention includes a silver halide light-sensitive emulsion layer and a non-light-sensitive photographic subsidiary layer. It is particularly preferred to incorporate the color image stabilizer of the formula (III) into a green-sensitive silver halide emulsion layer.

Any known silver halides such as silver chloride, silver bromide, silver chlorobromide, silver bromoiodide, silver chloroiodide, silver chlorobromoiodide and the like can be used as the silver halide for the photographic emulsion in the present invention. In addition, halogen conversion-type silver halide grains as described in British Pat. No. 635,841 may also be used effectively.

Any hydrophilic colloid employed in usual silver halide emulsions may be used as the binder for the silver halide. For example, gelatin, albumin, gum arabic, agar agar, cellulose derivatives (e.g., carboxycellulose alkyl esters, hydroxyethyl cellulose, carboxymethylhydroxyethyl cellulose, etc.), synthetic resins (e.g., polyvinyl alcohol, polyvinyl pyrrolidone, etc.), and the like are merely a small sampling of those hydrophilic colloids which can be used in the present invention.

The generally used ratio of silver halide: binder is 1: from about 0.1 to 20. A preferred grain size for the silver halide is from about 0.05 to about 5 microns. Neither of these ranges are limitative, and they can be varied in a manner known to the art.

Also, the photographic emulsion can be subjected to chemical ripening with active gelatin or with the use of a sulfur compound in a manner as described in U.S. Pat. Nos. 1,574,944, 1,623,499 or 2,410,689.

The photographic emulsion can be chemically sensitized with gold salts such as are described in U.S. Pat. No. 2,399,083, with reducing agents such as the stannous salts described in U.S. Pat. No. 2,487,850, reducing agents such as the polyamines described in U.S. Pat. No. 2,521,925, with bis(β-aminoethyl)sulfides and the water-soluble salts thereof described in U.S. Pat. No. 2,521,926, with compounds containing a labile selenium atom as described in U.S. Pat. Nos. 3,297,446, 3,297,447 and 3,442,653, can be sensitized by the addition of polyalkylene glycols as described in U.S. Pat. Nos. 2,423,549 and 2,441,389, or with various derivatives of alkylene oxides as described in U.S. Pat. No. 2,240,472 and British Pat. No. 443,559.

In the present invention, at least one photographic emulsion layer can be spectrally sensitized with a methine dye. Suitable sensitizing dyes which can be used include cyanine dyes, merocyanine dyes, complex cyanine dyes, complex merocyanine dyes, holopolar cyanine dyes, hemicyanine dyes and styryl dyes. Useful dyes are dyes such as cyanine dyes, merocyanine dyes and complex merocyanine dyes.

These sensitizing dyes can be used individually or in combination. A large number of examples of the combined use of sensitizing dyes is known for the purpose of super-sensitization.

In addition to the sensitizing dyes, substances which show a supersensitizing action without any substantial absorption of visible light such as the compounds containing a pyrimidinylamino group or a triazinylamino group described in U.S. Pat. Nos. 2,933,390, 3,511,664, 3,615,613, 3,615,632, 3,615,641, etc., aromatic organic acid-formaldehyde condensates described in British Pat. No. 1,137,580, azaindenes, cadmium salts, or the like can be incorporated in the emulsion.

The light-sensitive material of the present invention can possess a spectrally sensitized emulsion layer or layers and a spectrally non-sensitized emulsion layer or layers at the same time, with the spatial relationship of the layers in the light-sensitive material being varied as the occasion demands.

The hydrophilic colloid used in the photographic light-sensitive material of the invention is advantageously hardened by the generally used hardeners of the aldehyde series, methylol series, 1,4-dioxane series, aziridine series, isoxazole series, carbodiimide series, active halogen series, active vinyl series, etc.

The photographic light-sensitive material of the invention can contain a plasticizer such as glycerin, a coating aid such as saponin, polyethylene glycol monolauryl ether, etc., a lubricating agent such as a silicone resin, paraffin, etc., a matting agent such as starch, titanium dioxide, a silicate, etc., a water-soluble filter dye of the oxonol series, etc., a brightening agent of the stilbene series, triazine series, oxazole series, coumarin series, etc., antistatic agents such as the ionic polymers described in U.S. Pat. No. 2,861,056.

In addition, the photographic light-sensitive material of the invention can contain ultraviolet light absorbing agents such as benzotriazole, etc., or may contain colloidal silver, carbon black or the like.

The color image stabilizer represented by the general formula (III) of the present invention can be suitably used in a range of about 1 to about 500 weight %, preferably 5 to 300 weight %, of the coupler of the general formula (II), although the amount thereof will depend on the specific coupler employed. If the amount is smaller than about 1 weight %, the effects of preventing light fading of the color image and of preventing the formation of yellow stain by light in the non-image areas are too small to be used practically. On the other hand, if the amount is excessively large in comparison with that of the coupler, disadvantages may occur in that the color density obtained is decreased due to hindering of color coupling and in that the desired color hue is not obtained due to abnormal color formation. Generally, a suitable amount of the magenta coupled represented by the general formula (II) to be coated is about 100 mg/m$^2$ to about 3,000 mg/m$^2$.

The color image stabilizers of the formula (III) according to the present invention can be used individually or as a mixture of two or more kinds thereof. Further, the color image stabilizer of the formula (III) can be used together with other known fading inhibiting agents.

Examples of other known fading inhibiting agents are the hydroquinone derivatives as described in U.S. Pat. Nos. 2,360,290, 2,418,613, 2,675,314, 2,701,197, 2,704,713, 2,728,659, 2,732,300, 2,735,765, 2,710,801 and 2,816,028 and British Pat. No. 1,363,921, the gallic acid derivatives as described in U.S. Pat. Nos. 3,457,079 and 3,069,262 and Japanese patent publication No. 13,496/1968 corresponding to U.S. Pat. No. 3,770,436, the p-alkoxyphenols as described in U.S. Pat. Nos. 2,735,765 and 3,698,909, the p-oxyphenol derivatives as described in U.S. Pat. Nos. 3,432,300, 3,573,050, 3,574,627 and 3,764,337, etc. These additional fading inhibiting agents are used in an amount of about 1 to about 500% by weight based on the weight of color image stabilizer employed in this invention.

Typical examples of high boiling organic solvents which can be used to disperse the color image stabilizer of the formula (III) used in the present invention alone or together with a 3-anilino-5-pyrazolone coupler of the formula (II) are dibutyl phthalate, dinonyl phthalate, butyl benzoate, diethylhexyl sebacate, butyl stearate, dinonyl maleate, tributyl citrate, tricresyl phosphate, dioctylbutyl phosphate, trihexyl phosphate and others as described in U.S. Pat. No. 3,676,137, diethyl succinate, dioctyl adipate, 3-ethylbiphenyl, liquid dye stabilizers described, as improved type photographic dye image stabilizers, in *Product Licensing Index*, Vol. 83, pages 26 to 29 (March, 1971), etc.

Examples of low boiling organic solvents which can be used as a subsidiary solvent together with a high boiling organic solvent are ethyl acetate, butyl acetate, ethyl propionate, ethyl formate, butyl formate, nitroethane, carbon tetrachloride, chloroform, hexane, cyclohexane, ethylene glycol, acetone, ethanol, dimethylformamide, dioxane, etc. Further, benzene, toluene, xylene, etc., can be added to such a solvent.

Examples of surface active agents which are used to disperse a solution in which the color image stabilizer of the formula (III) used in the present invention is dissolved alone or in combination with a 3-anilino-5-pyrazolone coupler of the formula (II) in an aqueous solution of a hydrophilic protective colloid are saponin, sodium alkylsulfosuccinates, sodium alkylbenzenesulfonates, etc. Examples of suitable hydrophilic protective colloids are gelatin, casein, carboxymethylcellulose, polyvinyl alcohol, polyvinyl pyrrolidone, styrene-maleic anhydride copolymer, a condensation product of styrene-maleic anhydride copolymer and polyvinyl alcohol, a salt of polyacrylic acid, ethyl cellulose, etc. However, the present invention is not to be construed to be limited to these specific examples.

Couplers which can be used in the present invention are as follows. Open chain ketomethylene type compounds, for example, those described in U.S. Pat. Nos. 3,341,331, 2,875,057 and 3,551,155, German patent application (OLS) No. 1,547,868, U.S. Pat. Nos. 3,265,506, 3,582,322 and 3,725,072, German patent application (OLS) No. 2,162,899, U.S. Pat. Nos. 3,369,895 and 3,408,194, German patent applications (OLS) Nos. 2,057,941, 2,213,461, 2,219,917, 2,261,361 and 2,263,875, etc., can be used as yellow couplers.

Phenol or naphthol derivatives are mainly used as cyan couplers. Examples thereof are described in U.S. Pat. Nos. 2,369,929, 2,474,293, 2,698,794, 2,895,826, 3,311,476, 3,458,315, 3,560,212, 3,582,322, 3,591,383, 3,386,301, 2,434,272, 2,706,684, 3,034,892 and 3,583,971, German patent application (OLS) No. 2,163,811 corresponding to U.S. Pat. No. 3,770,436, Japanese patent publication No. 28,836/1970 corresponding to British Patent No. 1,201,110, Japanese patent application No. 33,238/1973 corresponding to U.S. Pat. No. 3,933,500, etc.

Development inhibitor releasing type couplers (the so-called DIR couplers) or compounds capable of releasing a compound inhibiting development during the color coupling reaction can also be used. Examples thereof are described in U.S. Pat. Nos. 3,148,062, 3,227,554, 3,253,924, 3,617,291, 3,622,328, and 3,705,201, British Pat. No. 1,201,110, U.S. Pat. Nos. 3,297,445, 3,379,529 and 3,639,417, etc.

Examples of colored couplers which can be used in the present invention are those described in U.S. Pat. Nos. 2,434,272, 3,476,564 and 3,476,560, Japanese patent application No. 45,971/1973 corresponding to German patent application (OLS) No. 2,418,959, U.S. Pat. Nos. 3,034,892, 3,386,301, 2,434,272, 3,148,062, 3,227,554, 3,701,783 and 3,617,291, etc.

Supports which can be used in the present invention include those generally employed for photographic light-sensitive elements, such as a cellulose nitrate film, a cellulose acetate film, a cellulose acetate butyrate film, a cellulose acetate propionate film, a polystyrene film, a polyethylene terephthalate film, a polycarbonate film, a laminate of these polymers, a thin glass film and a paper. A baryta coated paper, a paper which is coated or laminated with an $\alpha$-olefin polymer particularly those obtained from an olefin monomer having from 2 to 10 carbon atoms, such as polyethylene, polypropylene and ethylene-butene copolymers, and a synthetic resin film in which adhesiveness to other polymers is improved by roughening the surface thereof, such as described in Japanese patent publication No. 19,068/1972 corresponding to British Pat. No. 1,237,475, can also be used to advantage as a support.

These supports can be transparent or opaque, depending on the purposes of the photographic elements. Colored transparent supports which contain a dye or a pigment can also be used.

Examples of opaque supports include opaque films produced by incorporating into a transparent film a dye or a pigment such as titanium oxide, or surface-treated synthetic resin films such as those described in Japanese patent publication No. 19,068/1972, as well as intrinsically opaque materials such as paper. Highly light-shielding papers and synthetic films containing, for example, carbon black or dyes can also be used. A subbing layer can be usually provided on the support. The surfaces of the supports can also be pre-treated with a corona discharge, a UV radiation treatment, a flame treatment and the like in order to further improve the adhesiveness.

In the practice of the present invention it is naturally preferred to effectively prevent discoloration due to light for an ultraviolet radiation absrobing layer to be also provided over a photographic light-sensitive emulsion layer in which images are formed on a support.

In the present invention color processing agents conventionally used such as color developing agents, bleaching agents, fixing agents can be used without any limitation on the kinds of agents. Further, the present invention can be advantageously applied to color light-sensitive elements such as those described in U.S. Pat. No. 3,902,905 in which a reduced amount of silver is employed. Also, intensifying agents of a color intensification method such as those described in German patent application (OLS) No. 1,813,920, U.S. Pat. No. 3,834,907, Japanese patent application No. 128,327/1974 corresponding to German patent application (OLS) No. 2,549,837 can be used without any limitation.

A color light-sensitive element to which the present invention can be applied is a conventional color light-sensitive element particularly a color light-sensitive element for printing. Further, the present invention can be applied to a color photographic process such as described in U.S. Pat. Nos. 3,227,550, 3,227,551 and 3,227,552 and U.S. Patent Application Provisional Publication B. 351,673, particularly to a color diffusion transfer photographic process.

The color light-sensitive element according to the present invention can be subjected after exposure to color development using an aromatic primary amine compound such as a p-phenylenediamine derivative. Representative examples of color developing agents which can be used include N,N-diethyl-p-phenylenediamine, 2-amino-5-diethylaminotoluene, 2-amino-5-(N-ethyl-N-laurylamino)toluene, 4-[N-ethyl-N-($\beta$-hydroxyethyl)amino]aniline, 3-methyl-4-amino-N-ethyl-N-($\beta$-hydroxyethyl)aniline, and the inorganic acid salts thereof, 4-amino-3-methyl-N-ethyl-N-($\beta$-methanesulfonamidoethyl)-aniline sesquisulfate monohydrate as described in U.S. Pat. No. 2,193,015, N-(2-amino-5-diethylaminophenylethyl)methanesulfonamide sulfate as described in U.S. Pat. No. 2,592,364, N,N-dimethyl-p-phenylenediamine hydrochloride, 3-methyl-4-amino-N-ethyl-N-methoxyethylaniline as described in Japanese Patent Application (OPI) 64,933/1973 corresponding to U.S. Pat. No. 3,816,134, and the like. Suitable color developing agents which can be used are also described in greater detail in L. F. A. Mason, *Photographic Processing Chemistry,* pages 226 to 229, Focal Press, London (1966).

The color developer may further contain generally used additives such as a sulfite, carbonate bisulfite, bromide or iodide of an alkali metal, benzyl alcohol and the like.

Other processing solutions, e.g., a bleaching solution, a fixing solution, a stabilizing solution, etc., known in the art also may advantageously be used. These processing solutions may be used in combinations of two or more thereof, e.g., as a bleach-fixing solution, a fix-stabilizing solution or a bleach-fix-stabilizing solution.

Such solutions are well known in the art, and any of such known solutions are useful. A bleaching solution contains a silver oxidizing agent(s), e.g., water-soluble ferricyanides, a simple water-soluble ferric, cupric or cobaltic salt, and complex salts of an alkali metal and polyvalent cations with an organic acid. Typical examples of the polyvalent cations are ferric ions, cobaltic ions, cupric ions, etc. Typical examples of the organic acids are ethylene diamine tetraacetic acid, nitrilotriacetic acid, etc. A fixing solution contains a silver halide solvent(s), for example, a water-soluble thiosulfate, water-soluble thiocyanate, etc. A stabilizer solution contains, of course, a stabilizer such as formaldehyde, citric acid, etc. Specific examples of these compounds are illustrated in U.S. Pat. No. 3,582,322.

The color light-sensitive elements of the present invention, after exposure, can be subjected to a conventional color processing and also can be subjected to a color intensification method as described below. Examples of suitable intensification methods are the method using a peroxide as described in U.S. Pat. Nos. 3,674,490 and 3,761,265, German patent application (OLS) No. 2,056,360, Japanese patent applications (OPI) Nos. 6,338/1972 and 10,538/1972 corresponding to British Pat. No. 1,341,719 and U.S. Pat. No. 3,765,890, respectively, Japanese patent applications (OPI) Nos. 13,335/1977, 13,334/1977 and 13,336/1977; the method using a cobalt complex salt as described in German patent application (OLS) No. 2,226,770, Japanese patent applications Nos. 9,728/1973 and 9,729/1973, Japanese patent applications Nos. 76,101/1974, 20,196/1975, 57,041/1975, 83,863/1975 and 87,484/1975; and the method using chlorous acid as described in Japanese patent applications Nos. 128,327/1974, 139,917/1974 and 27,784/1975.

The present invention is described in greater detail by reference to the following examples. However, the present invention is not to be interpreted as being limited to these examples.

EXAMPLE 1

10 g of Magenta Coupler (A) and 2 g of Color Image Stabilizer Compound (1) were dissolved in a mixture of 5 ml of tricresyl phosphate and 10 ml of ethyl acetate. The solution was dispersed in 80 g of a 10% aqueous gelatin solution containing sodium dodecylbenzene sulfonate. Then the dispersion thus prepared was mixed with 145 g of a green-sensitive silver chlorobromide emulsion (containing 50 mol% of bromide and 7 g of silver) and 2-hydroxy-4,6-dichloro-s-triazine sodium salt as a hardener and sodium dodecylbenzenesulfonate as a coating aid were added to the mixture. The mixture was coated on a paper support laminated with polyethylene on both surfaces thereof in an amount of 0.3 g/m$^2$ in terms of silver and dried (Sample I).

In the same manner as described above, samples having the following combinations were prepared.

TABLE 1

| Sample | Magenta Coupler | | Color Image Stabilizer | |
|---|---|---|---|---|
| I* | (A) | 10 g | (1) | 2 g |
| II** | (A) | 10 g | Di-tert-octyl Hydroquinone | 2 g |
| III** | (A) | 10 g | — | |
| IV** | Comparison Coupler (H) | 10 g | — | |
| V** | " | " | Di-tert-octyl Hydroquinone | 2 g |
| VI** | " | " | (1) | 2 g |

*Present invention
**Comparison

Comparison Coupler (H)

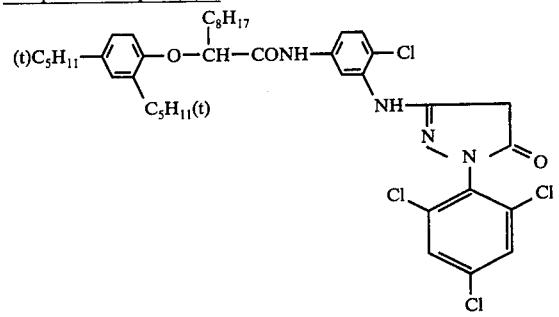

These samples were exposed to light at 1,000 lux for one second and processed in the following manner.

| Processing Step | Temperature (° C) | Time |
|---|---|---|
| Development | 33 | 3 min 30 sec |
| Bleach-Fixing | 33 | 1 min 30 sec |
| Washing | 28 to 35 | 3 min |
| Drying | | |

The processing solutions employed had the following compositions.

| Developer Solution | | |
|---|---|---|
| Benzyl Alcohol | 15 | ml |
| Sodium Sulfite | 3 | g |
| Potassium Bromide | 0.4 | g |
| Hydroxylamine Sulfate | 2 | g |
| 4-Amino-3-methyl-N-ethyl-N-β-(methanesulfonamido)ethylaniline | 5 | g |
| Sodium Carbonate | 30 | g |
| Diethylenetriamine Pentaacetic Acid | 5 | g |
| Water to make | 1,000 (pH 10.1) | ml |

| Bleach-Fixing Solution | | |
|---|---|---|
| Ammonium Thiosulfate (70 wt% aq. soln.) | 150 | ml |
| Sodium Sulfite | 15 | g |
| Sodium Ferric Ethylenediamine Tetraacetate | 40 | g |
| Ethylenediamine Tetraacetic Acid | 4 | g |
| Water to make | 1,000 (pH 6.9) | ml |

Each sample having dye images thus formed was subjected to fading testing for 4 weeks using an ultraviolet absorbing filter made by Fuji Photo Film Co., Ltd., which cut out ultraviolet light having wavelengths shorter than 400 nm, in a fluorescent lamp fading meter (20,000 lux). The results obtained are shown in Table 2 below.

TABLE 2

| Sample | Change in Yellow Density Fogged Area | Change in Magenta Density Initial Density of 2.0 |
|---|---|---|
| I | +0.02 | −0.20 |
| II | +0.20 | −0.50 |
| III | +0.30 | −0.80 |
| IV | +0.15 | −0.60 |
| V | +0.04 | −0.40 |
| VI | +0.03 | −0.30 |

It is apparent from the above table that the 3-anilino-5-pyrazolone coupler of the formula (II) used in the present invention has the tendency to yellow by light in comparison with the comparison coupler (compare Sample III with Sample IV in Table 2), that in Sample II containing the coupler of the formula (II) used in the present invention the decrease in the yellowing due to light by using a known fading inhibitor (di-tert-octyl hydroquinone) is much less than that in Sample V containing the comparison coupler and that the stability of color image and the yellowing at non-image area are remarkably improved.

Dispersions the same as described for Samples I to VI were again prepared and stored at room temperature for 4 weeks. The dispersions were dissolved at 50° C. and filtered using Toyo Filter Paper No. 3. The amounts of the residue are shown in Table 3.

TABLE 3

| Dispersion | Residue |
|---|---|
| I | 0 |
| II | 0 |
| III | 0 |
| IV | 3 g |
| V | 4 g |
| VI | 3 g |

The results in the above table show that storage of Dispersion I corresponding to that used in the present invention does not result in the formation of a residue and the dispersion is stable.

The results shown above demonstrate the superior features of the present invention of an improvement in color image stability and a reduction in yellowing at non-image area and that the dispersion is stable.

EXAMPLE 2

Samples shown in Table 4 were prepared in the same manner as in Example 1 and subjected to exposure, processing and fading test in the same manner as in Example 1.

TABLE 4

| Sample | Magenta Coupler | | Color Image Stabilizer | |
|---|---|---|---|---|
| VII** | (A) | 10 g | — | — |
| VIII* | (A) | 10 g | (11) | 4 g |
| IX** | (A) | 10 g | Comparison Compound (21) | 4 g |

*Invention
**Comparison

Comparison Compound (21)

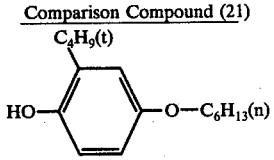

TABLE 5

| Sample | Change in Yellow Density Fogged Area | Change in Magenta Density Initial Density of 2.0 |
|---|---|---|
| VII | +0.31 | −0.80 |
| VIII | +0.02 | −0.18 |
| IX | +0.20 | −0.50 |

Sample VIII according to the present invention is superior to Sample IX using known technique in view of the remarkably low level of the increase of yellow density at the non-image area and the prevention of fading of magenta density due to the light exposure.

While the invention has been described in detail and with reference to specific embodiments thereof, it will be apparent to one skilled in the art that various changes and modifications can be made therein without departing from the spirit and scope thereof.

What is claimed is:

1. A color photographic light-sensitive silver halide element comprising a support having thereon a photographic layer containing (a) at least one magenta coupler represented by the general formula (II):

(II)

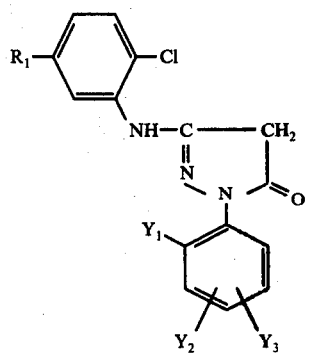

wherein $Y_1$ represents a halogen atom, an alkyl group having 1 to 5 carbon atoms or an alkoxy group having 1 to 5 carbon atoms; $Y_2$ and $Y_3$, which may be the same or different, each represents a hydrogen atom, a halogen atom, an alkyl group having 1 to 5 carbon atoms or an alkoxy group having 1 to 5 carbon atoms; $R_1$ represents $R_2CONH$—, $R_2OOC$—, $R_2NHSO_2$— or

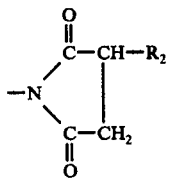

wherein $R_2$ represents a hydrogen atom, a straight chain or branched chain alkyl group, having 1 to 35 carbon atoms, an alkenyl group having 2 to 22 carbon atoms, a cycloalkyl group having 5 to 22 carbon atoms, an aralkyl group having 7 to 22 carbon atoms or a cycloalkenyl group having 5 to 22 carbon atoms, and (b) at least one color image stabilizer represented by the general formula (III):

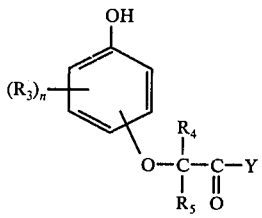

(III)

wherein $R_3$ represents a hydrogen atom, an alkyl group having 1 to 35 carbon atoms, an alkenyl group having 1 to 22 carbon atoms, a cycloalkyl group having 5 to 22 carbon atoms, an aralkyl group having 7 to 22 carbon atoms, a cycloalkenyl group having 5 to 22 carbon atoms and an aryl group having 6 to 35 carbon atoms; *n* represents an integer of 1 to 4 and where *n* is 2 to 4, the $R_3$ groups may be the same or different; the

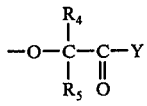

group is substituted at a position unsubstituted with $R_3$ and wherein $R_4$ and $R_5$, which may be the same or different, each represents a hydrogen atom, an alkyl group having 1 to 35 carbon atoms, an alkenyl group, a cycloalkyl group, an aralkyl group or a cycloalkenyl group; and Y represents a hydrogen atom, an alkyl group having 1 to 35 carbon atoms, an alkenyl group, an aralkyl group, a cycloalkyl group, a cycloalkenyl group, an aryl group having 6 to 35 carbon atoms, an alkoxy group, an aryloxy group, an alkylthio group, an arylthio group, an arylamino group, an alkylamino group, a cyclic amino group, a heterocyclic amino group or a hydroxy group.

2. The color photographic light-sensitive element as claimed in claim 1, wherein the $R_2$ groups in the general formula (II) may be substituted with one or more of a substituent selected from the group consisting of a halogen atom, a nitro group, a cyano group, an aryl group, an alkoxy group, a carboxy group, an alkylcarbonyl group, an arylcarbonyl group, an alkoxycarbonyl group, an aryloxycarbonyl group, a formyl group, a sulfo group, an acyloxy group, a sulfamoyl group, a carbamoyl group, an acylamino group, a diacylamino group, a ureido group, a thioureido group, a urethane group, a thiourethane group, a sulfonamido group, a heterocyclic group, an arylsulfonyloxy group, an alkylsulfonyloxy group, an arylsulfonyl group, an alkylsulfonyl group, an arylthio group, an alkylthio group, an alkylsulfinyl group, an arylsulfinyl group, an alkylamino group, a dialkylamino group, an anilino group, an N-arylanilino group, an N-alkylanilino group, an N-acylanilino group, a hydroxy group and a mercapto group.

3. The color photographic light-sensitive element as claimed in claim 1, wherein the alkyl group, the alkenyl group, the cycloalkyl group, the aralkyl group, and the cycloalkenyl group represented by R in the general formula (III) may be substituted with one or more of a substituent selected from the group consisting of a halogen atom, a nitro group, a cyano group, an aryl group, an alkoxy group, an aryloxy group, a carboxy group, an alkylcarbonyl group, an arylcarbonyl group, an alkoxycarbonyl group, an aryloxycarbonyl group, a formyl group, a sulfo group, an acyloxy group, a sulfamoyl group, a carbamoyl group, an acylamino group, a diacylamino group, a ureido group, a thioureido group, a urethane group, a thiourethane group, a sulfonamido group, a heterocyclic group, an arylsulfonyloxy group, an alkylsulfonyloxy group, an arylsulfonyl group, an alkylsulfonyl group, an arylthio group, an alkylthio group, an alkylsulfinyl group, an arylsulfinyl group, an alkylamino group, a dialkylamino group, an anilino group, an N-arylanilino group, an N-alkylanilino group, an N-acylanilino group, a hydroxy group and a mercapto group.

4. The color photographic light-sensitive element as claimed in claim 1, wherein the aryl group represented by $R_3$ in the general formula (III) may be substituted with one or more of a substituent selected from the group consisting of an alkyl group, an alkenyl group, a cycloalkyl group, an aralkyl group, a cycloalkenyl group, a halogen atom, a nitro group, a cyano group, an aryl group, an alkoxy group, an aryloxy group, a carboxy group, an alkylcarbonyl group, an arylcarbonyl group, an alkoxycarbonyl group, an aryloxycarbonyl group, a formyl group, a sulfo group, an acyloxy group, a sulfamoyl group, a carbamoyl group, an acylamino group, a diacylamino group, a ureido group, a thioureido group, a urethane group, a thiourethane group, a sulfonamido group, a heterocyclic group, an arylsulfonyloxy group, an alkylsulfonyloxy group, an arylsulfonyl group, an alkylsulfonyl group, an arylthio group, an alkylthio group, an alkylsulfinyl group, an arylsulfinyl group, an alkylamino group, dialkylamino group, an anilino group, an N-alkylanilino group, an N-arylanilino group, an N-acylanilino group, a hydroxy group, and a mercapto group.

5. The color photographic light-sensitive element as claimed in claim 1, wherein the groups represented by $R_4$ and $R_5$ in the general formula (III) may be substituted with one or more of a substituent selected from the group consisting of an alkyl group, an alkenyl group, a cycloalkyl group, an aralkyl group, a cycloalkenyl group, a halogen atom, a nitro group, a cyano group, an aryl group, an alkoxy group, an aryloxy group, a carboxy group, an alkylcarbonyl group, an arylcarbonyl group, an alkoxycarbonyl group, an aryloxycarbonyl group, a formyl group, a sulfo group, an acyloxy group, a sulfamoyl group, a carbamoyl group, an acylamino group, a diacylamino group, a ureido group, a thioureido group, a urethane group, a thiourethane group, a sulfonamido group, a heterocyclic group, an arylsulfonyloxy group, an alkylsulfonyloxy group, an arylsulfonyl group, an alkylsulfonyl group, an arylthio group, an alkylthio group, an alkylsulfinyl group, an arylsulfinyl group, an alkylamino group, dialkylamino group, an anilino group, an N-alkylanilino group, an N-arylanilino group, an N-acylanilino group, a hydroxy group, and a mercapto group.

6. The color photographic light-sensitive element as claimed in claim 1, wherein the alkyl group, the alkenyl group, the aralkyl group and the alicyclic hydrocarbon group represented by Y in the general formula (III) may be substituted with one or more of a substituent selected from the group consisting of an alkyl group, an alkenyl group, a cycloalkyl group, an aralkyl group, a cycloalkenyl group, a halogen atom, a nitro group, a cyano group, an aryl group, an alkoxy group, an aryloxy group, a carboxy group, an alkylcarbonyl group, an arylcarbonyl group, an alkoxycarbonyl group, an aryloxycarbonyl group, a formyl group, a sulfo group, an acyloxy group, a sulfamoyl group, a carbamoyl group, an acylamino group, a diacylamino group, a ureido group, a thioureido group, a urethane group, a thiourethane group, a sulfonamido group, a heterocyclic group, an arylsulfonyloxy group, an alkylsulfonyloxy group, an arylsulfonyl group, an alkylsulfonyl group, an arylthio group, an alkylthio group, an alkylsulfinyl group, an arylsulfinyl group, an alkylamino group, dialkylamino group, an anilino group, an N-alkylanilino group, an N-arylanilino group, an N-acylanilino group, a hydroxy group, and a mercapto group.

7. The color photographic light-sensitive element as claimed in claim 1, wherein the aryl group represented by Y in the general formula (III) may be substituted with one or more of a substituent selected from the group consisting of an alkyl group, an alkenyl group, a cycloalkyl group, an aralkyl group, a cycloalkenyl group, a halogen atom, a nitro group, a cyano group, an aryl group, an alkoxy group, an aryloxy group, a carboxy group, an alkylcarbonyl group, an arylcarbonyl group, an alkoxycarbonyl group, an aryloxycarbonyl group, a formyl group, a sulfo group, an acyloxy group, a sulfamoyl group, a carbamoyl group, an acylamino group, a diacylamino group, a ureido group, a thioureido group, a urethane group, a thiourethane group, a sulfonamido group, a heterocyclic group, an arylsulfonyloxy group, an alkylsulfonyloxy group, an arylsulfonyl group, an alkylsulfonyl group, an arylthio group, an alkylthio group, an alkylsulfinyl group, an arylsulfinyl group, an alkylamino group, dialkylamino group, an anilino group, an N-alkylanilino group, an N-arylanilino group, an N-acylanilino group, a hydroxy group, and a mercapto group.

8. The color photographic light-sensitive element as claimed in claim 1, wherein said photographic layer is a green-sensitive silver halide emulsion layer.

9. The color photographic light-sensitive element as claimed in claim 1, wherein said color image stabilizer is present in an amount of about 1 to about 500% by weight based on the weight of said magenta coupler of the general formula (II).

10. The color photographic light-sensitive element as claimed in claim 8, further including a blue-sensitive silver halide emulsion layer and a red-sensitive silver halide emulsion layer on said support.

11. The color photographic light-sensitive element as claimed in claim 1, wherein $R_1$ is $R_2CONH$—.

12. The color photographic light-sensitive element as claimed in claim 1, wherein $R_1$ is $R_2OOC$—.

13. The color photographic light-sensitive element as claimed in claim 1, wherein $R_1$ is $R_2NHSO_2$—.

14. The color photographic light-sensitive element as claimed in claim 1, wherein $R_1$ is

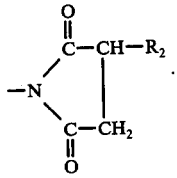

15. The color photographic light-sensitive element as claimed in claim 1, wherein $R_4$ and $R_5$ are said hydrogen and said alkyl, respectively.

16. The color photographic light-sensitive element as claimed in claim 1, wherein $R_4$ and $R_5$ are both said alkyl.

17. The color photographic light-sensitive element as claimed in claim 1, wherein $R_4$ and $R_5$ are both said hydrogen.

18. The color photographic light-sensitive element as claimed in claim 15, therein Y is said alkoxy group.

19. The color photographic light-sensitive element as claimed in claim 15, wherein Y is said arylamino group.

20. The color photographic light-sensitive element as claimed in claim 15, wherein Y is said alkylamino group.

21. The color photographic light-sensitive element as claimed in claim 15, wherein Y is said heterocyclic amino group.

22. The color photographic light-sensitive element as claimed in claim 15, wherein Y is said aryloxy group.

* * * * *